US009743813B2

(12) United States Patent
Courtney et al.

(10) Patent No.: US 9,743,813 B2
(45) Date of Patent: Aug. 29, 2017

(54) HAND DRYER

(75) Inventors: Stephen Benjamin Courtney, Malmesbury (GB); Peter David Gammack, Malmesbury (GB); Leigh Michael Ryan, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 13/587,453

(22) Filed: Aug. 16, 2012

(65) Prior Publication Data

US 2013/0042496 A1 Feb. 21, 2013

(30) Foreign Application Priority Data

Aug. 17, 2011 (GB) ..... 1114181.9

(51) Int. Cl.
*A47K 10/48* (2006.01)

(52) U.S. Cl.
CPC ..... *A47K 10/48* (2013.01)

(58) Field of Classification Search
CPC ..... F26B 21/004; F26B 21/06; A47K 10/48
USPC .... 34/90, 201, 202, 209, 210, 218, 231, 232
See application file for complete search history.

(56) References Cited

U.S. PATENT DOCUMENTS

| | | | | |
|---|---|---|---|---|
| 1,997,387 | A | 4/1935 | McCord | |
| 2,853,591 | A | 4/1935 | Fine | |
| 4,398,310 | A * | 8/1983 | Lienhard | A47K 10/48 4/623 |
| 5,146,695 | A * | 9/1992 | Yang | 34/90 |
| 6,038,786 | A | 3/2000 | Aisenberg et al. | |
| 6,769,197 | B1 | 8/2004 | Tai | |
| 7,437,833 | B2 | 10/2008 | Sato et al. | |
| D599,059 | S | 8/2009 | Clerch | |
| 7,596,883 | B2 | 10/2009 | Kameishi | |
| 7,614,160 | B2 | 11/2009 | Kameishi et al. | |
| 7,774,953 | B1 | 8/2010 | Duran | |
| 7,971,368 | B2 | 7/2011 | Fukaya et al. | |
| 8,043,714 | B2 | 10/2011 | Hashimoto | |

(Continued)

FOREIGN PATENT DOCUMENTS

| | | |
|---|---|---|
| CN | 102665512 | 9/2012 |
| CN | 102670117 | 9/2012 |

(Continued)

OTHER PUBLICATIONS

Search Report mailed Dec. 13, 2011 directed towards GB Application No. 1114181.9; 1 page.

(Continued)

*Primary Examiner* — Jessica Yuen
(74) *Attorney, Agent, or Firm* — Morrison & Foerster LLP

(57) ABSTRACT

A wall-mountable hand dryer for drying one side of a user's hands at a time, the dryer having two nozzle sections—one for each hand—which nozzle sections are positioned towards the front of the dryer so that they are spaced away from the wall in use, the nozzle sections each extending to span the width of a user's open hand and being arranged for directing drying air down onto the front or back of said hand as it is inserted lengthwise underneath the nozzle sections from the front of the dryer, wherein the dryer comprises a downwardly pitched guide part positioned behind each nozzle section for guiding the pitch of the user's hands underneath the nozzle sections.

6 Claims, 16 Drawing Sheets

(56) References Cited

U.S. PATENT DOCUMENTS

| | | | |
|---|---|---|---|
| 8,136,262 | B2 | 3/2012 | Collins |
| 8,347,522 | B2 | 1/2013 | Dyson et al. |
| 8,544,186 | B2 | 10/2013 | Hsu |
| 8,607,472 | B2 | 12/2013 | Ishii et al. |
| 2007/0079524 | A1 | 4/2007 | Sato et al. |
| 2008/0052952 | A1 | 3/2008 | Nelson |
| 2008/0222910 | A1 | 9/2008 | Churchill et al. |
| 2008/0263889 | A1 | 10/2008 | Fukaya et al. |
| 2009/0000140 | A1 | 1/2009 | Collins |
| 2010/0192399 | A1 | 8/2010 | Sawabe et al. |
| 2011/0277342 | A1 | 11/2011 | Ishii et al. |
| 2012/0017459 | A1 | 1/2012 | Kikuchi et al. |
| 2012/0017460 | A1 | 1/2012 | Kikuchi et al. |
| 2013/0042495 | A1 | 2/2013 | Ryan et al. |
| 2013/0042497 | A1 | 2/2013 | Ryan et al. |
| 2013/0055588 | A1 | 3/2013 | Nakamura et al. |
| 2013/0269208 | A1 | 10/2013 | Gammack et al. |
| 2013/0276328 | A1 | 10/2013 | Gammack et al. |

FOREIGN PATENT DOCUMENTS

| | | | |
|---|---|---|---|
| DE | 30 36 623 | | 2/1982 |
| GB | 737054 | | 9/1955 |
| GB | 909069 | | 10/1962 |
| GB | 915674 | | 1/1963 |
| GB | 2 428 569 | | 2/2007 |
| GB | 2 428 570 | | 2/2007 |
| GB | 2 428 571 | | 2/2007 |
| GB | 2 450 561 | | 12/2008 |
| GB | 2 450 563 | | 12/2008 |
| JP | 61-179993 | | 11/1986 |
| JP | 4-221523 | | 8/1992 |
| JP | 9-56640 | | 3/1997 |
| JP | 9-135788 | | 5/1997 |
| JP | 9-215631 | | 8/1997 |
| JP | 10-113305 | | 5/1998 |
| JP | 10-257992 | | 9/1998 |
| JP | 11-283 | | 1/1999 |
| JP | 11-169317 | | 6/1999 |
| JP | 11169317 | A * | 6/1999 |
| JP | 2000-180 | | 1/2000 |
| JP | 2000-107073 | | 4/2000 |
| JP | 2000-157448 | | 6/2000 |
| JP | 2000-184987 | | 7/2000 |
| JP | 2001-361 | | 1/2001 |
| JP | 2002-136448 | | 5/2002 |
| JP | 2004-215879 | | 8/2004 |
| JP | 2007-98106 | | 4/2007 |
| JP | 2008-5883 | | 1/2008 |
| JP | 2008-272251 | | 11/2008 |
| JP | 2009-502392 | | 1/2009 |
| JP | 2013-22226 | | 2/2013 |
| JP | 2013-39377 | | 2/2013 |
| WO | WO-2009/011198 | | 1/2009 |
| WO | WO-2009/041001 | | 4/2009 |
| WO | WO-2010/088975 | | 8/2010 |
| WO | WO-2010/095250 | | 8/2010 |
| WO | WO-2010/095251 | | 8/2010 |
| WO | WO-2011/077625 | | 6/2011 |
| WO | WO-2013/024252 | | 2/2013 |

OTHER PUBLICATIONS

Mediclinics Catalogue 2009-2010, "Speedflow (RTM) Hand dryers," on pp. 14-15 and Technical specifications on p. 15 located at <http://www.mediclinics.co.uk/downloads/mediclinicscatalogue20092010.pdf> accessed on Jul. 16, 2012. (69 pages).

World Dryer: Press Release (May 31, 2011) "SLIMdri: The Bantamweight that Packs a Punch," Berkeley, IL, located at <http://www.worlddryer.com/node/267> accessed on Jul. 16, 2012. (1 page).

World Dryer: SLIMdri Hand Dryer. Surface-Mounted ADA Compliant Hand Dryer brochure located at <http://www.worlddryer.com/sites/default/files/92_MT050_SLIMdri_sellsheet.pdf> accessed Jul. 16, 2012. (2 pages).

Bobrick: TrimLine Surface-Mounted ADA Dryer B-7120, B-7128 Technical data Sheet located at <http://www.bobrick.co.uk/media/uploads/products/B-7120,_71281.pdf> accessed Jul. 16, 2012. (4 pages).

International Search Report and Written Opinion mailed Dec. 3, 2012, directed towards International Application No. PCT/GB2012/051831; 10 pages.

Ryan et al., U.S. Office Action mailed Jun. 16, 2014, directed to U.S. Appl. No. 13/587,422; 8 pages.

Ryan et al., U.S. Office Action mailed Oct. 31, 2014, directed to U.S. Appl. No. 13/587,422; 8 pages.

Ryan et al., U.S. Office Action mailed Jan. 21, 2015, directed to U.S. Appl. No. 13/587,517; 7 pages.

Ryan et al., U.S. Office Action mailed May 11, 2015, directed to U.S. Appl. No. 13/587,517; 7 pages.

Ryan et al., U.S. Office Action mailed Oct. 14, 2015, directed to U.S. Appl. No. 13/587,517; 8 pages.

Ryan et al., U.S. Office Action mailed Oct. 7, 2016, directed to U.S. Appl. No. 13/587,517; 10 pages.

Ryan et al., U.S. Office Action dated Mar. 28, 2016, directed to U.S. Appl. No. 13/587,517; 9 pages.

* cited by examiner

HAND DRYER

REFERENCE TO RELATED APPLICATIONS

This application claims the priority of United Kingdom Application No. 1114181.9 filed 17 Aug. 2011, the entire contents of which are incorporated herein by reference.

FIELD OF THE INVENTION

The present invention relates to the field of hand dryers.

BACKGROUND OF THE INVENTION

There are various designs of hand dryer on the market, which are typically installed in public washrooms as an alternative to paper towels.

FIG. 1 illustrates one conventional style of hand dryer a, currently marketed and sold under the model name AB01, as part of the Dyson Airblade® range of hand dryers. It works by using a motor-driven fan to force air at high pressure through an opposing pair of narrow, slit-like nozzles b, c, each less than 1 mm wide, partially enclosed in a drying cavity d. This creates two opposing thin sheets, or "blades", of high velocity air which act to strip water from the front and backs of a user's hands as they are 'dipped'—palms flat—into the drying cavity d between the opposing nozzles b, c.

The hand dryer shown in FIG. 1 provides a "two-sided" drying action: both the front and back of the hands are dried at the same time.

Another conventional style of hand dryer e is shown in FIG. 2. In this style of hand dryer, a single, relatively large nozzle f is provided, rather than opposing nozzles. This single nozzle f directs drying air down onto the user's hands, which are held underneath the nozzle f to dry. The air is ejected at relatively low speed compared to the hand dryer a in FIG. 1: too low to drive significant amounts of water moisture from the hands. Instead, the air is heated to promote evaporative drying of water moisture on the hands of the user. The drying action is a "hand-over-hand" action, requiring the user to rub the hands together under the nozzle f with the aim of encouraging the evaporative drying effect.

It is an object of the present invention to try to provide an improved hand dryer.

SUMMARY OF THE INVENTION

According to the present invention there is provided a wall-mountable hand dryer for drying one side of a user's hands at a time, the dryer having two nozzle sections—one for each hand—which nozzle sections are positioned towards the front of the dryer so that they are spaced away from the wall in use, the nozzle sections each extending to span the width of a user's open hand and being arranged for directing drying air down onto the front or back of said hand as it is inserted lengthwise underneath the nozzle sections from the front of the dryer, wherein the dryer comprises a downwardly pitched guide part positioned behind each nozzle section for guiding the pitch of the user's hands underneath the nozzle sections.

The dryer of the present invention does not rely on a two-sided drying action. Instead, the dryer is arranged for drying one side of a user's hand at a time: opposing nozzles are not used to dry both sides of the hand simultaneously. This is advantageous, because the use of opposing nozzles on conventional two-sided hand dryers places a restriction on the overall depth of the machine: sufficient depth is required to accommodate both sets of opposing nozzles, a reasonable gap between the nozzles for admitting the hands, and also the supply ducting for the opposing nozzles. By removing the requirement for opposing nozzles, this restriction is likewise removed.

At the same time, the dryer of the present invention advantageously dries a user's individual hands separately. In normal use, the user passes his (or her) hands lengthwise underneath the nozzle sections, first with the palm facing the nozzle sections and then—after turning over the hands—with the back of the hands facing the nozzle sections (or vice versa). There is no requirement in normal use to rub the hands together in the vein of the "hand-over-hand" drying method used on some conventional dryers: indeed, this is actively discouraged by the provision of dedicated nozzle parts for each hand.

A downwardly-pitched guide part is provided behind the nozzle sections for guiding the pitch of the hands in use. This advantageously increases the effective depth of the dryer on the wall by encouraging the user to pitch his hands downwardly in use. In combination with the removal of any requirement for opposing nozzles, this provides for a very shallow machine depth.

A preferred pitch for this guide part is 45 degrees. The guide part may be in the form of a continuous ramp surface, but this is not essential.

The guide part may be set back from the nozzles—a distance of at least 2 mm, but preferably more than 5 mm—to help prevent the drying air laminating on the guide part in use.

Taking account of any set-back where appropriate—as described above—the guide part preferably extends back all the way to the wall in use.

Each nozzle section extends to span the width of a user's hand, for effective drying across the full hand span of the user. Though not essential, a preferred range of lengths for the nozzle sections is 100-150 mm. This tends to ensure that the nozzle sections will effectively extend across the majority of user's hands in use. The precise length will be a trade-off between, on the one hand, a compact design and, on the other hand, the usability of the dryer for users with relatively large hands. Accordingly, the preferred length may vary—for example by country. However, a length specification of 120 mm for the nozzle sections (with a tolerance of ±10 mm) generally offers a good compromise in most cases. In any event, the guide part may be arranged to span the full length of each nozzle section, though again this is not essential.

The left-hand nozzle section may be banked to the right and the right-hand nozzle section may banked to the left. Consequently, the user is able to hold the hands at a corresponding banked attitude. This makes the action of using the dryer comfortable for the user, but still allows the user to hold his hands in close proximity to the nozzles across the full width of each hand.

The banking of the left-hand and right-hand nozzles also allows the user comfortably to pitch his hands downward in use.

The nozzle sections are preferably banked at the same angle, in which case their relative orientation may conveniently be described with reference to the angle between the nozzle sections—herein referred to as the Relative Bank Angle. A steep (small) Relative Bank Angle will tend to favour the pass of the user's hands with palms upwards (and inwards). Conversely, a shallow (large) Relative Bank Angle will tend to favour the pass of the user's hand with palm facing downwards (and outwards), particularly if the hands are pitched downwards in normal use. A Relative Bank Angle of around 115 degrees is considered to offer a good compromise.

The nozzle sections may be arranged symmetrically either side of the centreline of the dryer, though this is not essential.

The nozzle sections may each comprise an elongate air slot (or separate elongate sections of the same continuous air slot) or a row of air nozzles, one or more of which may be elongate. In a preferred embodiment, these elongate slots or rows of nozzles may be are arranged in a V-configuration when viewed from the front of the dryer.

The nozzle sections may conveniently be provided on an underside of the dryer, in which case this underside may also be V-shaped when viewed from the front of the dryer. The guide part may likewise be V-shaped, viewed along the pitch axis of the guide part.

A motor-driven fan will typically be provided to force drying air through the nozzles. In a preferred embodiment, the hand dryer is provided with a motor driven fan for forcing air through the nozzles at high speed: in excess of 100 m/s. This advantageously provides a momentum-drying action similar to the conventional two-sided hand dryer in FIG. 1 (which has the disadvantage that it must rely on opposing nozzles): as the user passes his hands underneath the nozzle parts, the high momentum airflow effectively strips water moisture from the user's hand.

The nozzle sections may be arranged to direct air vertically—or near vertically—down onto the user's hands. This helps prevent "spray-back" or "blow-back"—wet or dry air being blown back onto the user—particularly if relatively high airspeeds are used. Consequently, the nozzle sections do not need to be shielded from a user standing in front of the dryer (this shielding would increase the depth of the machine on the wall).

Directing the air down vertically (or near-vertical) is not essential, however: the nozzle sections may be arranged for directing air forwardly down onto the hands of the user, rather than straight down. Indeed, this may be preferable if the nozzle sections are positioned so that they are relatively close to the wall, because it allows the user to position his hands further from the wall in use. Where the air is directed forwardly down onto the hands, the angle of declination may be controlled to keep spray-back and blow-back within acceptable limits, with a declination angle in excess of 50 degrees being preferred.

The nozzle sections may be arranged so that the left-hand nozzle section directs air along a first direction—outwardly to the left of the dryer—and the right-hand nozzle section directs air along a second direction—outwardly to the right of the dryer. A preferred angle of divergence for the first and second direction is 100-120 degrees.

The first and second direction may also have a forward component—so that the air is directed forwardly down onto the user's hands, but either side of the user's body. In this case, the diverging angle of the air jets can be controlled in conjunction with the declination angle to keep control of blow back and splash back within tolerable limits.

The use of diverging air jets also has the advantage that the user can bank his hands such that the air jets are directed at a normal to the surface of the hands (viewed from the front of the dryer), which may assist the drying time.

The hand dryer may be provided with a drying cavity, but this is not essential and may be disadvantageous if the desire is to minimise the depth of the machine on the wall.

BRIEF DESCRIPTION OF THE DRAWINGS

Embodiments of the invention will now be described with reference to the accompanying drawings, in which.

DETAILED DESCRIPTION OF THE INVENTION

Figure 3:
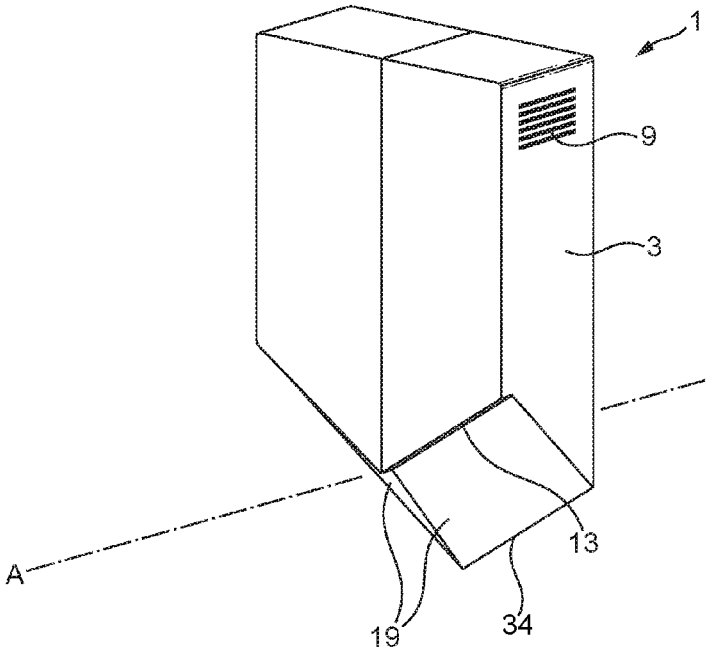
FIG. 3-5 are, respectively a perspective view, front view and side view of a hand dryer according to the present invention.
Figure 4:
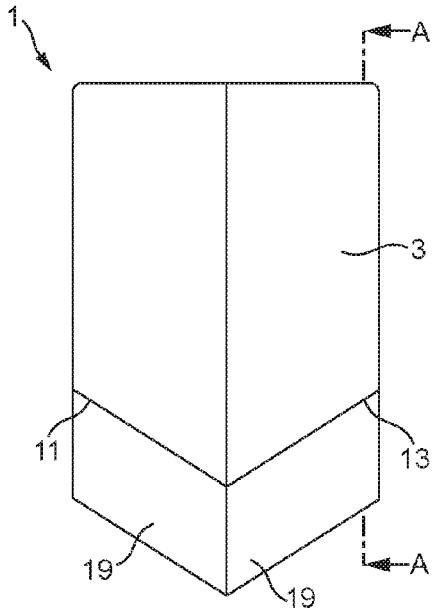
Figure 5:
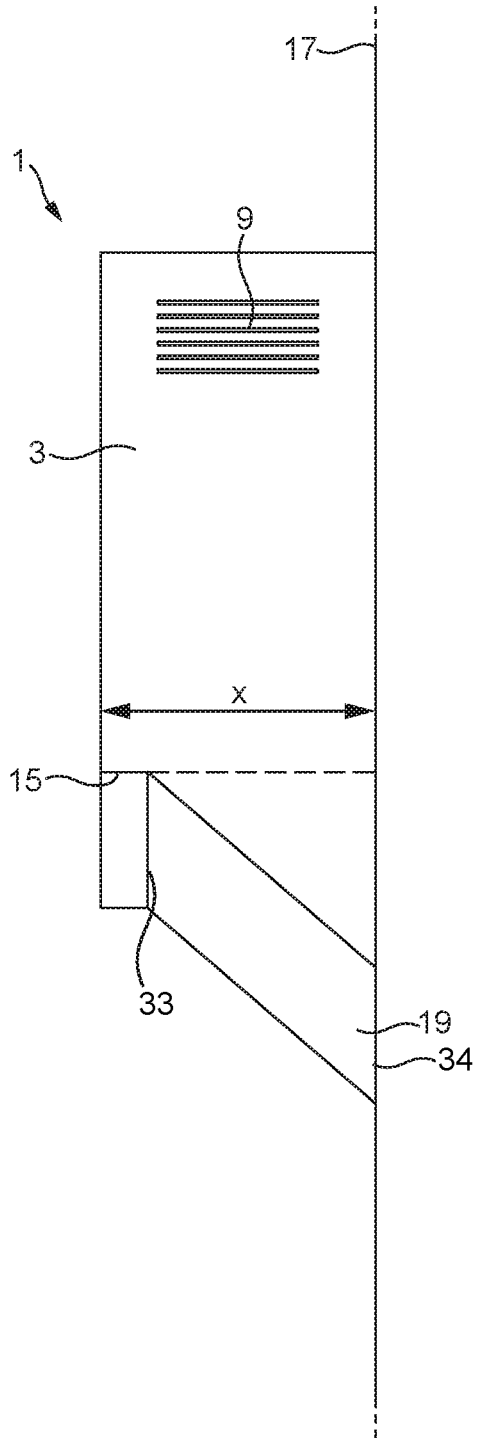
Figure 6:
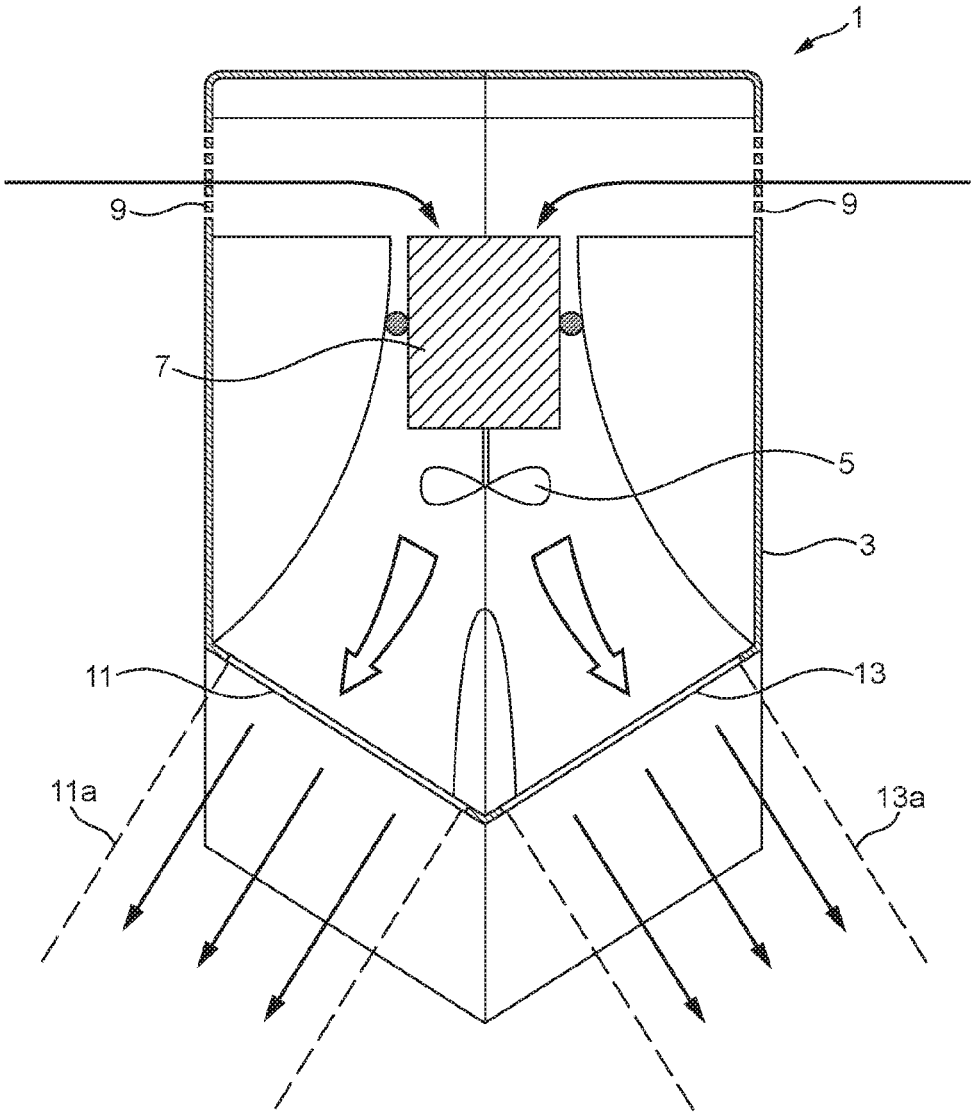
FIG. 6 is a schematic front sectional view showing the principal interior components of the hand dryer in FIGS. 3-5.

FIGS. 3-5 each show a wall-mountable hand dryer 1, here illustrated in its normal wall-mounted orientation. FIG. 6 shows the principal interior components of the hand dryer 1, in highly schematic form.

The hand dryer 1 comprises a main casing 3, which houses a ducted fan 5. A motor 7 is provided inside the main casing to drive the fan 5, which draws air through intakes 9 on either side of the main casing 3 and forces the air at high speed (>100 m/s) out through two nozzle sections: a left-hand nozzle section 11, on the left-hand side of the dryer 1, and a right-hand nozzle section 13 on the right-hand side of the dryer 1. These nozzle sections 11, 13 are positioned on an underside 15 of the dryer 1, and run along a front lower edge of the main casing 3 so that they are spaced from the wall 17 a distance x in use (FIG. 5).

Figure 7:
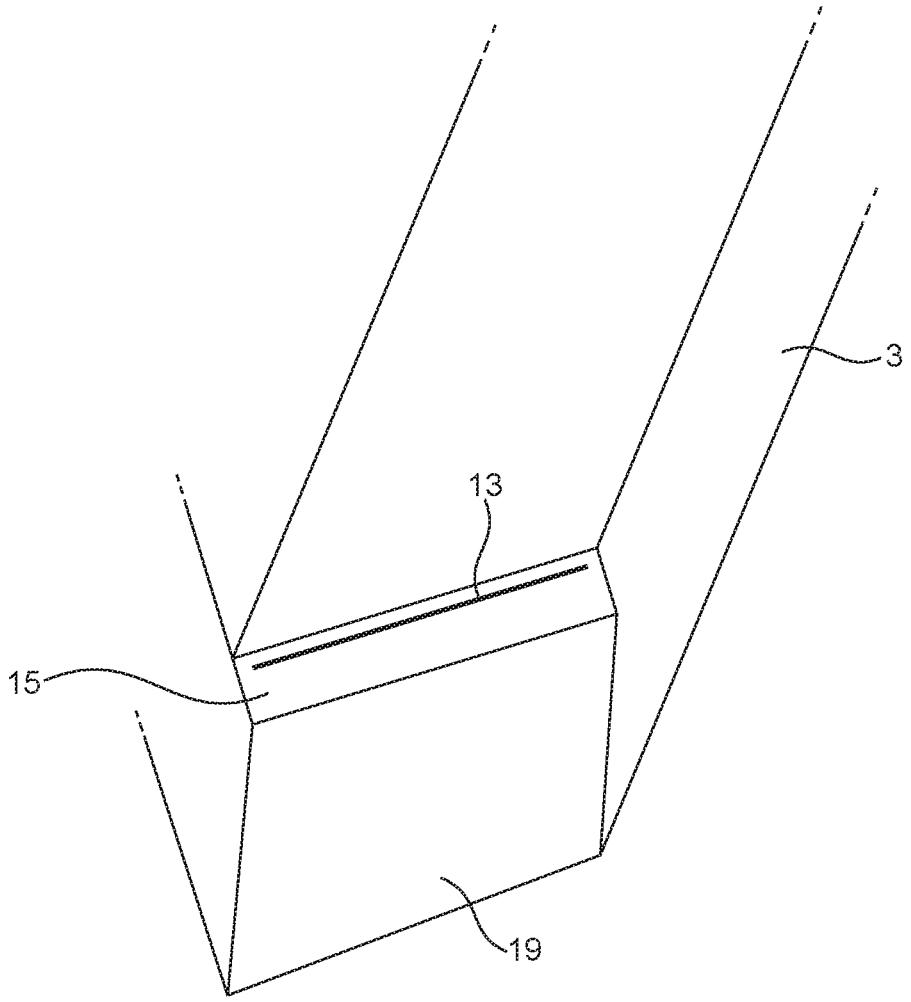
FIG. 7 is a partial perspective view looking underneath the hand dryer shown in FIGS. 3-5.

The nozzle sections 11, 13 are each in the form of an elongate air slot—less than 1 mm in width—arranged so that they are generally parallel with the wall (the elongate air slot 13 is shown in FIG. 7, looking from underneath the dryer 1). Because the nozzle sections are thin, the drying air is ejected through each of the slots 11, 13 in the form of thin sheets of air 11*a*, 13*a* (FIG. 5).

Each air slot 11, 13 is 120 mm in length: intended so that the corresponding 'air-sheets' 11*a*, 13*a* each span the width of a user's open hand.

In use, the hands are inserted lengthwise front-to-back underneath the nozzle sections 11, 13, and the high-speed air-sheets 11*a*, 13*a* are directed down onto the hands to 'scrape' water from the hands as they are subsequently withdrawn underneath the nozzle sections 11, 13.

Figure 8A:
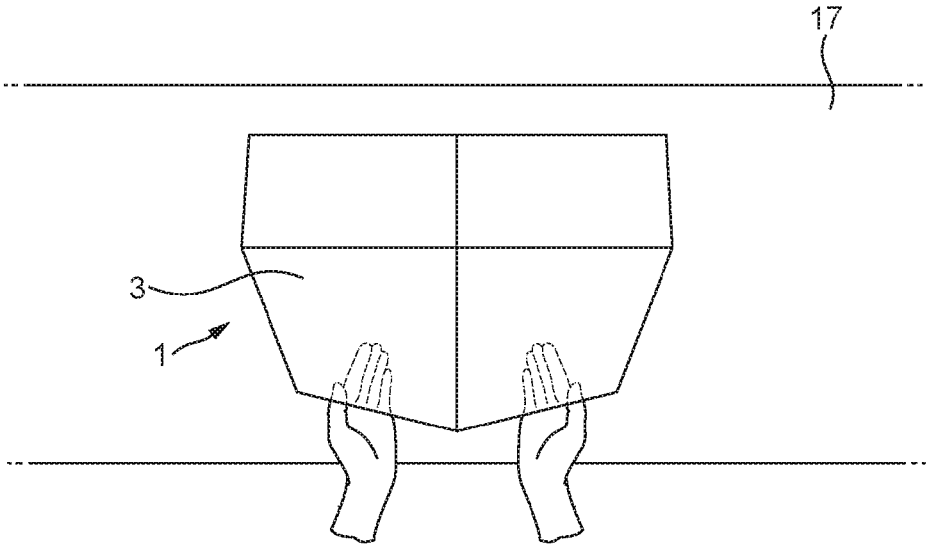
FIGS. 8*a* and 8*b* are perspective views—looking down from above—illustrating normal use of the hand dryer shown in FIGS. 3-5.
Figure 8B:
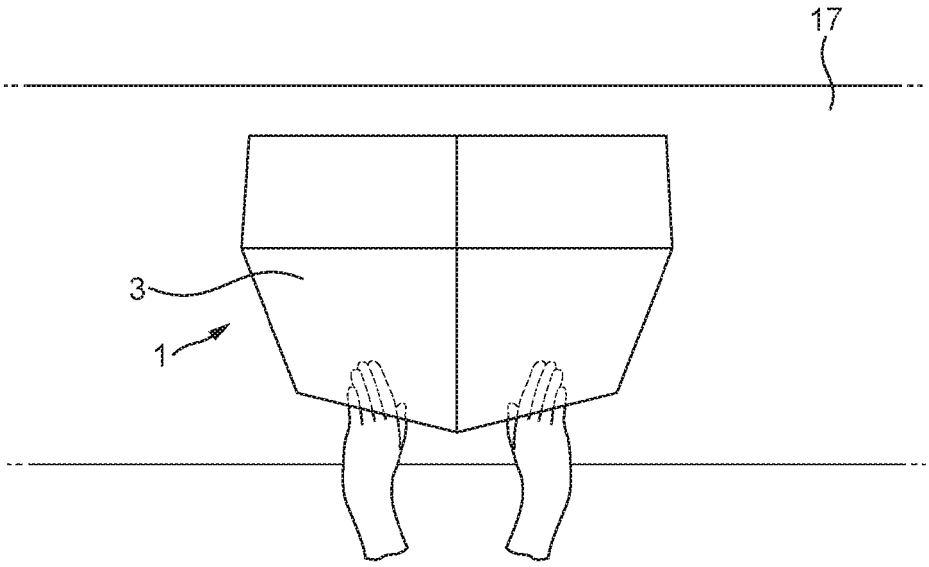

The hands are dried one side at a time: first, the user passes his (or her) hands forth and back underneath the nozzle sections with the palm facing up towards the nozzle sections (referred to below as the "standard pass"). This is illustrated in FIG. 8*a*. Then—after turning over the hands—the user passes his (or her) hands forth and back underneath the nozzle sections with the back of the hands facing up towards the nozzle sections (referred to below as the "reverse pass"). This is illustrated in FIG. 8*b*. The "standard pass" and "reverse pass" may each be repeated, as required, and carried out in any order.

A conventional sensor arrangement (not shown) can be used to turn on the motor in response to the detection of a user's hands. The same sensor arrangement may be used subsequently to turn the motor off in response to a null detection, or else the motor may be operated on a timer. Use of a sensor arrangement is not essential: the dryer may alternatively be arranged for manual operation.

Figure 1:
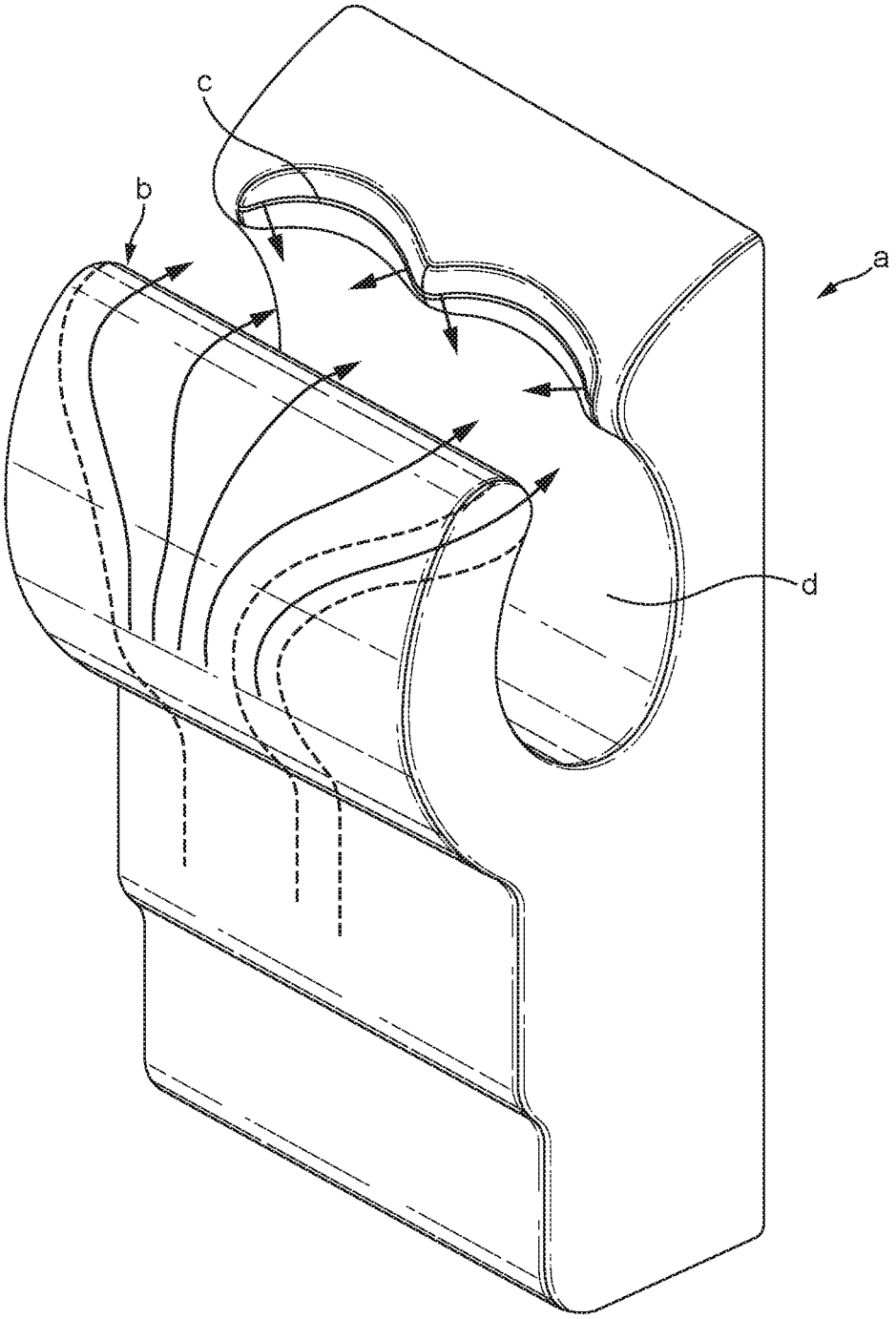
FIG. 1 is a perspective view of a conventional two-sided hand dryer.
Figure 2:
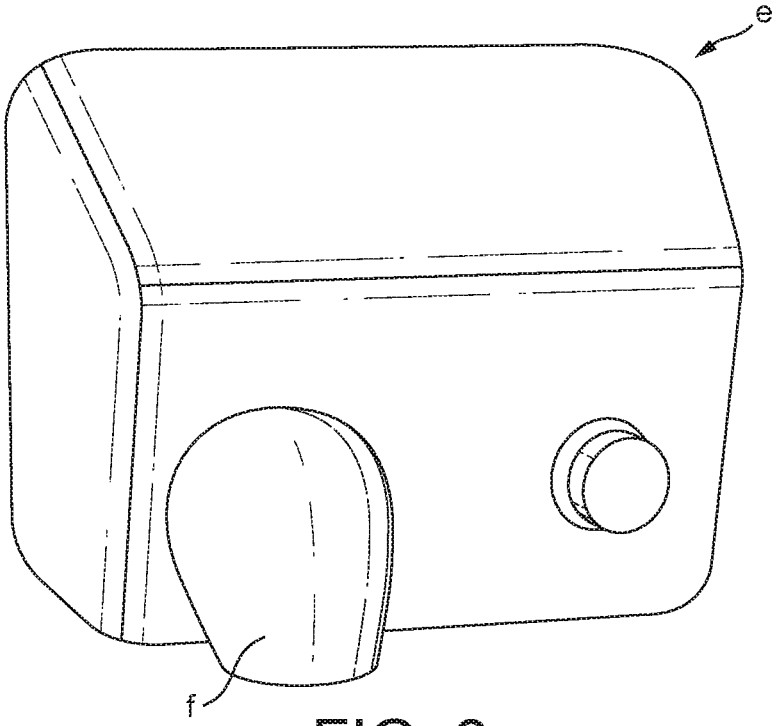
FIG. 2 is a perspective view of an alternative style of conventional hand dryer.
Figure 9A:
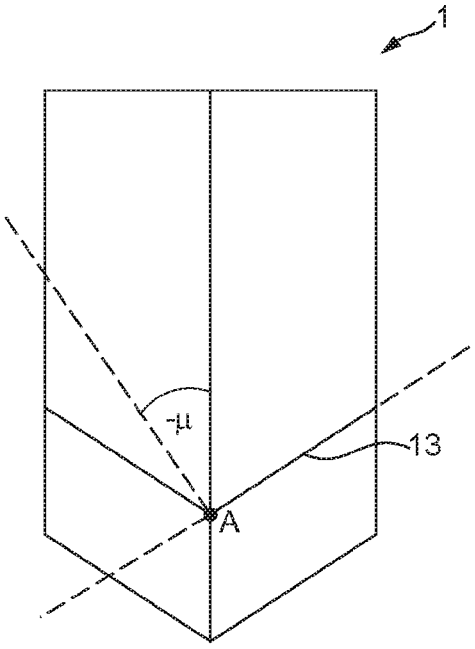
FIGS. 9*a* and 9*b* are front views of the hand dryer shown in FIGS. 3-5, illustrating banking of the nozzle sections on the dryer.
Figure 9B:
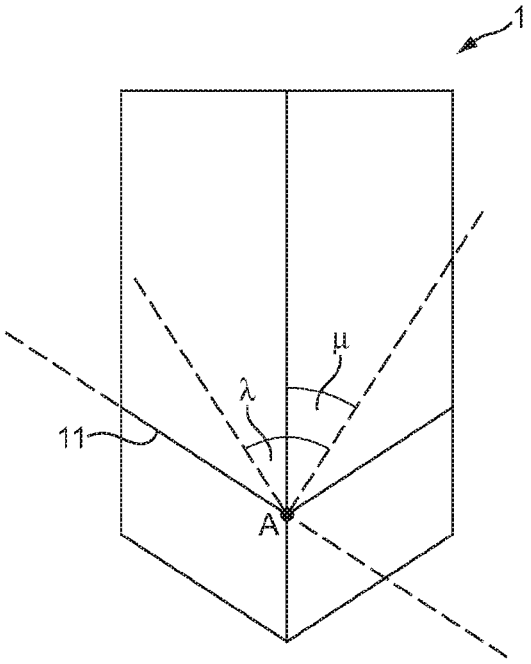
Figure 10:
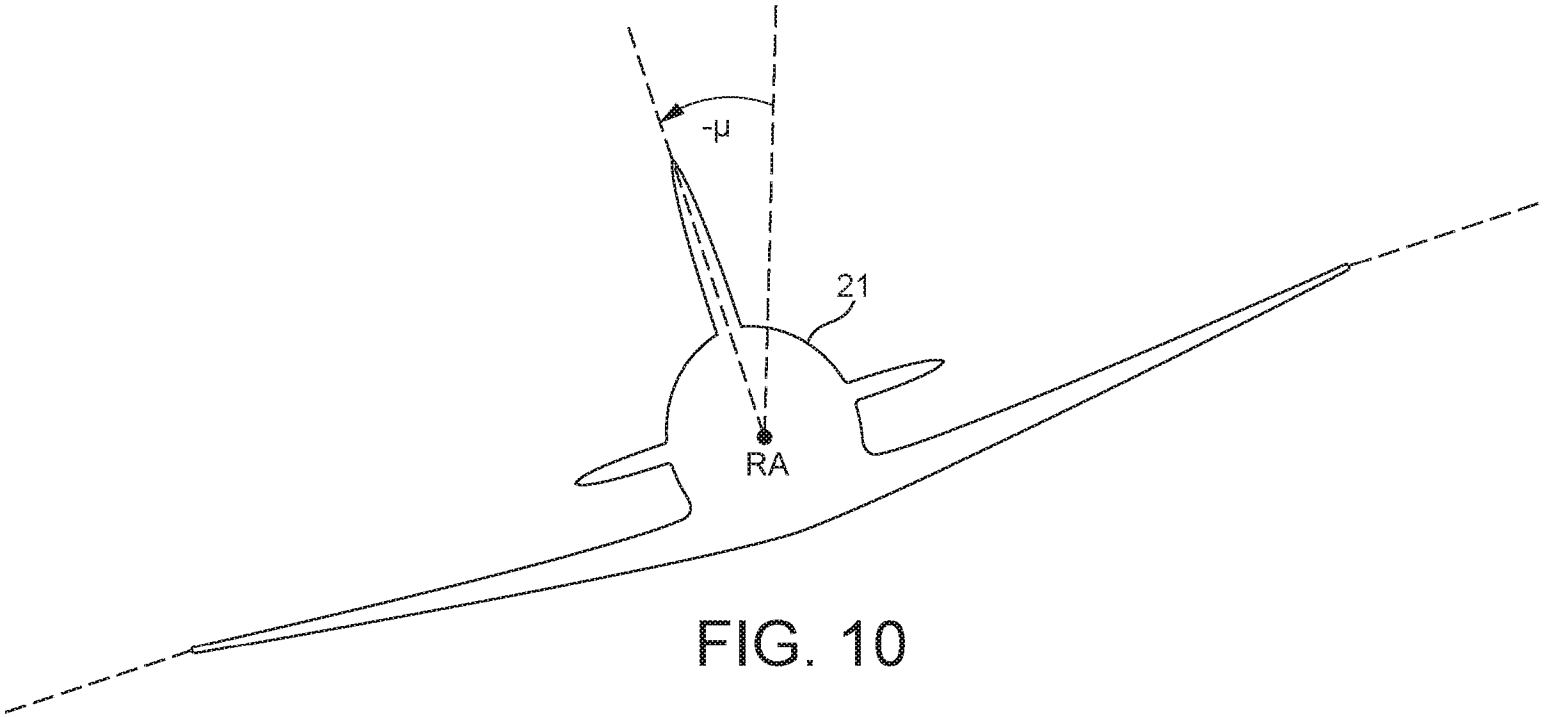
FIG. 10 is a greatly simplified outline rear view of an aircraft, intended to illustrate the analogy between banking of the nozzle sections on a hand dryer, in the context of the present invention, and banking of an aircraft in flight.

The left-hand nozzle section 11 is banked to the right and the right-hand nozzle section 13 is banked to the left. This is best illustrated in FIGS. 9*a* and 9*b*, which between them show the nozzle sections 11, 13 banked at an angle $+\mu$ about $-\mu$ an axis A (also shown in FIG. 1)—analogous to the banking of an aircraft 21 about its Roll Axis, RA (FIG. 10). Viewed from the front of the hand dryer the nozzles have a V-configuration, symmetrical about the centerline of the dryer. The angle $\lambda(=2\mu)$ is referred to here as the Relative Bank Angle.

Figure 11:
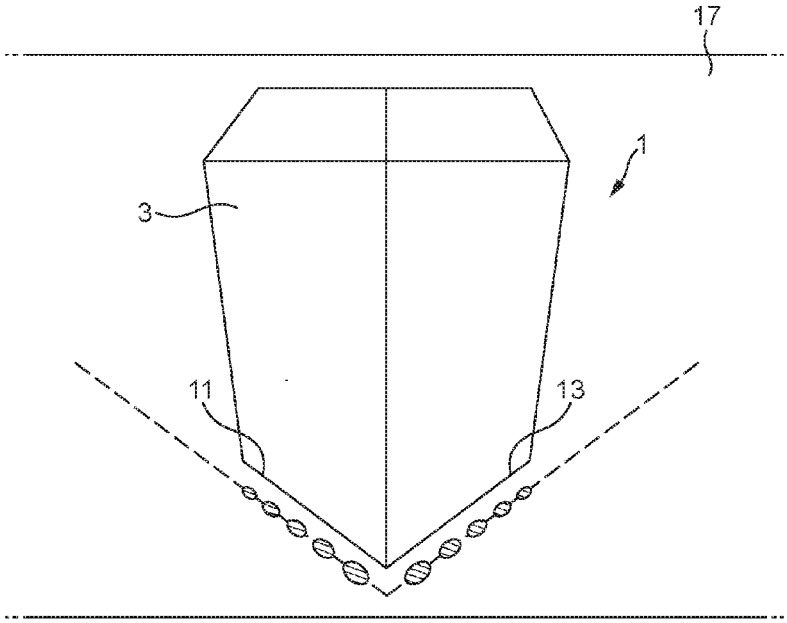
FIG. 11 is a front perspective view of the hand dryer in FIG. 3-5—looking down from above—illustrating banking of the user's hands in use.

In use, the user banks his hands accordingly during both the standard pass and the reverse pass. This is illustrated in FIG. 11: here looking along the roll axis of the hands—again, analogous to the roll axis of an aircraft—at a section taken through the hands. This makes the drying action more comfortable for the user—particularly when the hands are passed underneath the nozzle sections with the palms facing upwards, which could be uncomfortable for a user if the hands were required to be held flat (roll angle of the hands=0°) in close proximity to the air slots 11, 13.

Figure 12:
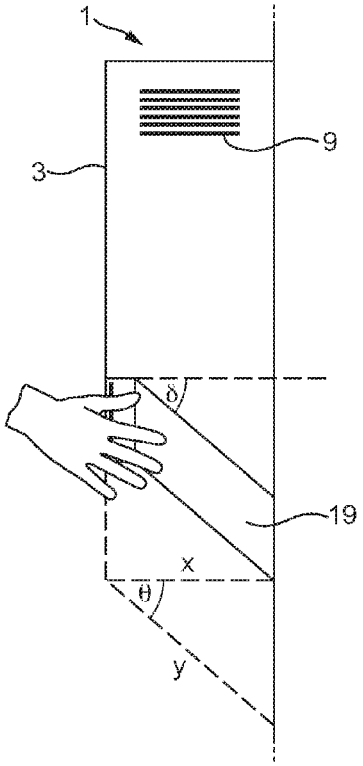
FIG. 12 is a view similar to FIG. 5, illustrating pitching of the user's hands in use.

It is preferable for the user to pitch his hands downwards in use, because this increases the effective depth of the dryer 1 on the wall, reducing the tendency for the user's fingertips to come into contact with the wall 17, underneath the dryer 1. This pitching action of the hands is illustrated in FIG. 12, which for clarity shows the right hand only of the user, during a standard pass. Note that the effective depth y of the dryer can be expressed as $x/\cos\theta$, where $\theta$ is the pitch angle of the hands.

A downwardly-pitched guide part is provided behind each of the nozzle sections 11, 13 to help control the pitch angle, $\theta$, of the hands in use. This guide part is in the form of a continuous ramp surface 19 with terminal end 34 which encourages the user to pitch his hands in order to avoid making contact with the ramp surface.

The user will generally pitch his hands in sympathy with the ramp surface 19, and so as a general rule the pitch of the ramp surface 19 can be set to provide the desired effective depth y for a given depth x according to the equation:

$$y=x/\cos\sigma,$$

where $\sigma$ is the pitch angle of the ramp surface 19.

For example, if the depth x is 200 mm, then the ramp surface 19 may be pitched at an angle of 45 degrees to provide an effective depth of approximately 280 mm.

Again, because the nozzle sections 11, 13 are banked, the user is able comfortably to hold his hands palm upwards in close proximity to the air slots 11, 13, even when the hands are pitched downwards at an angle, which otherwise would be quite uncomfortable for the user if the user were required to hold his hands flat (roll angle=0°).

Figure 13:
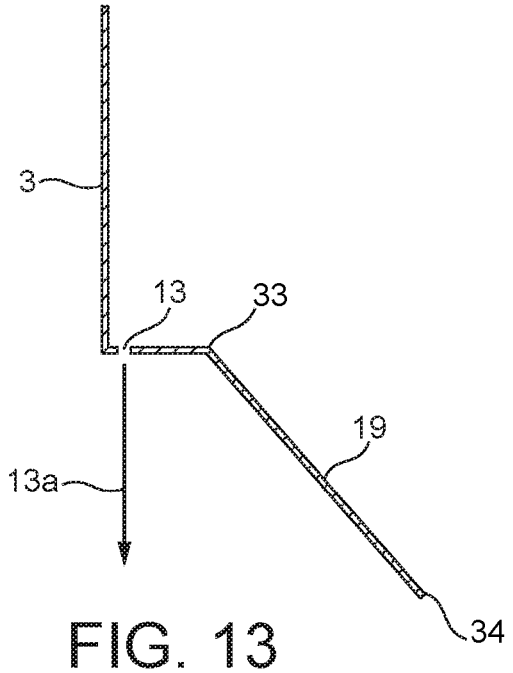
FIG. 13 is a sectional view of part of the dryer in FIGS. 3-5, taken along the line A-A in FIG. 4.
Figure 14:
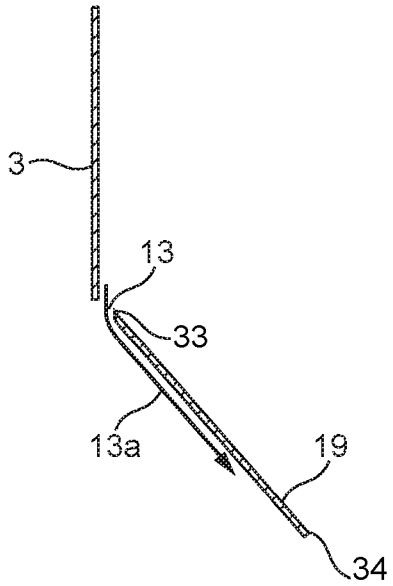
FIG. 14 is a comparative view corresponding to FIG. 13, but showing an alternative configuration for the hand dryer.

The start 33 of the ramp surface 19 is set back from the air nozzles to help prevent the airflow laminating on the ramp surface which is undesirable for optimum performance (compare FIG. 13 with FIG. 14, the latter showing an arrangement in which the ramp surface is not set back: resulting in possible lamination of the airflow onto the ramp surface, particularly in use when airflow is deflected back off the user's hand).Setting the ramp surface back a distance of at least 2 mm is considered necessary to prevent significant performance reduction. Setting the guide ramp back at least 5 mm is considered preferable.

Figure 15A:
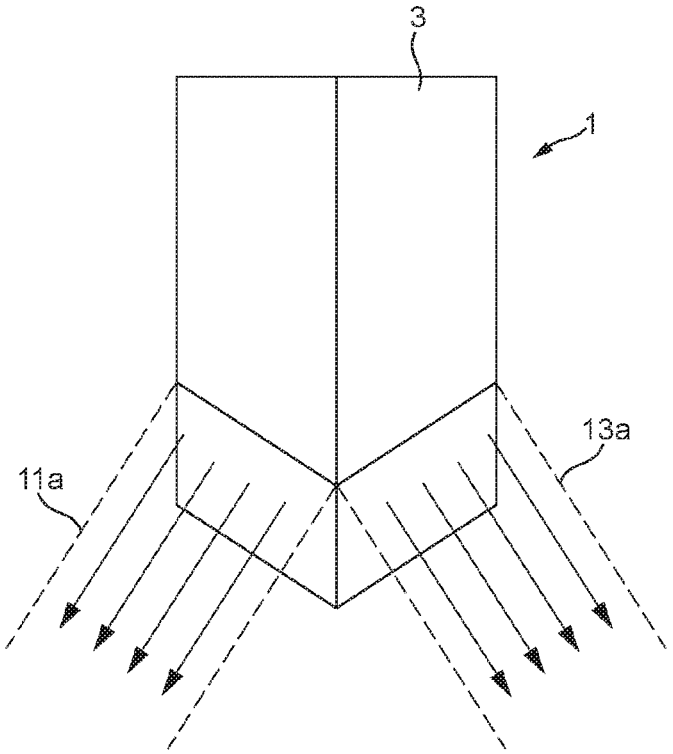
FIGS. 15*a* and 15*b* are, respectively, front and side views of the hand dryer shown in FIG. 3-5, illustrating the direction of the drying airflow in use.
Figure 15B:
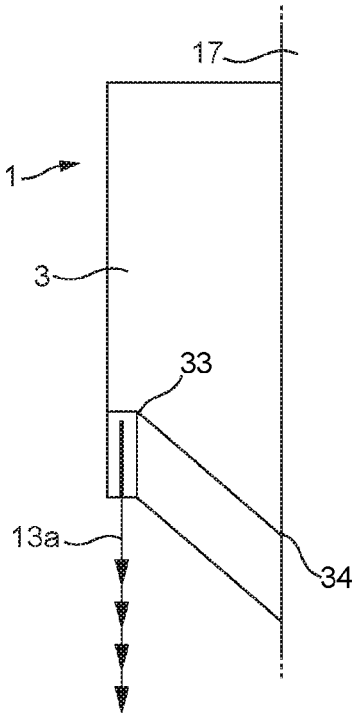

The precise direction of the drying airflow may vary, independently of the bank angle of the nozzle sections 11, 13. In the arrangement shown in FIGS. 3 to 5, the air-sheets are directed outwardly and downwardly—but not forwardly towards the user (see FIGS. 15*a* and 15*b*). Consequently, blow-back and spray-back onto the user's face and body is limited.

Figure 16A:
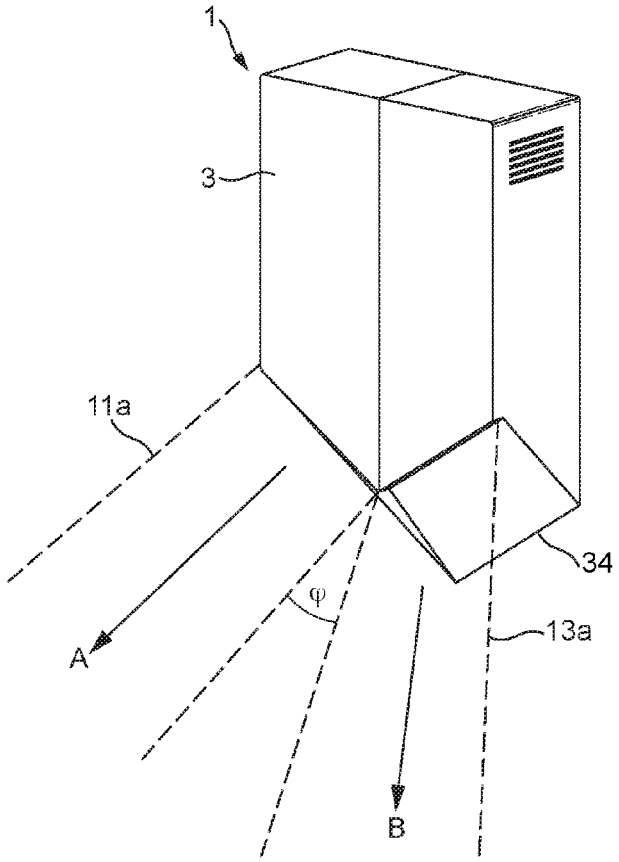
FIGS. 16*a* and 16*b* are, respectively, front perspective and side views of an alternative hand dryer, illustrating a different direction for the drying airflows.
Figure 16B:
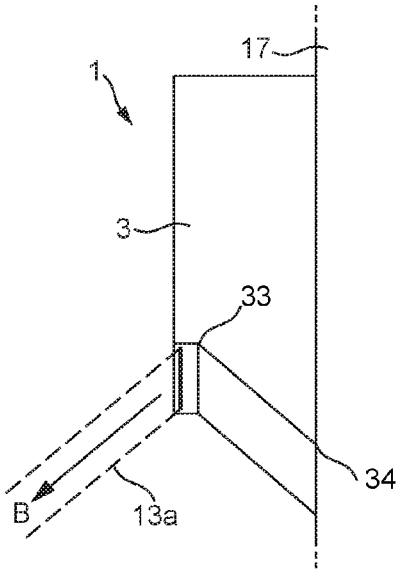
Figure 16C:
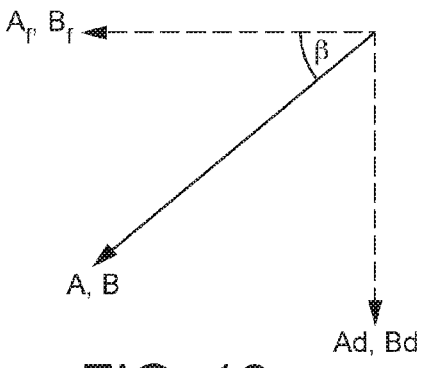
FIG. 16*c* is a vector diagram of the direction vectors A, B in FIG. 16*a;*

FIGS. 16*a*, 16*b* and 16*c* show a slightly different arrangement. Here, the left-hand nozzle section 11 is arranged to direct air outwardly along a first direction A—to the left of the dryer 1. Similarly, the right hand nozzle-section 13 is arranged to direct air outwardly along a second direction B—to the right of the dryer 1. However, the first and second directions A, B each have both a downward component $A_d$, $B_d$ and a forward component $A_f$, $B_f$. Consequently, drying air from the nozzle sections 11, 13 is directed forwards towards the user. This helps to space the user's hands from the wall in use; however, because the air-sheets 11*a*, 13*a* are directed outwardly to the left and right, the drying air tends to pass downwards either side of the user, nevertheless limiting blow-back and spray-back onto the user's face and body.

Figure 17:
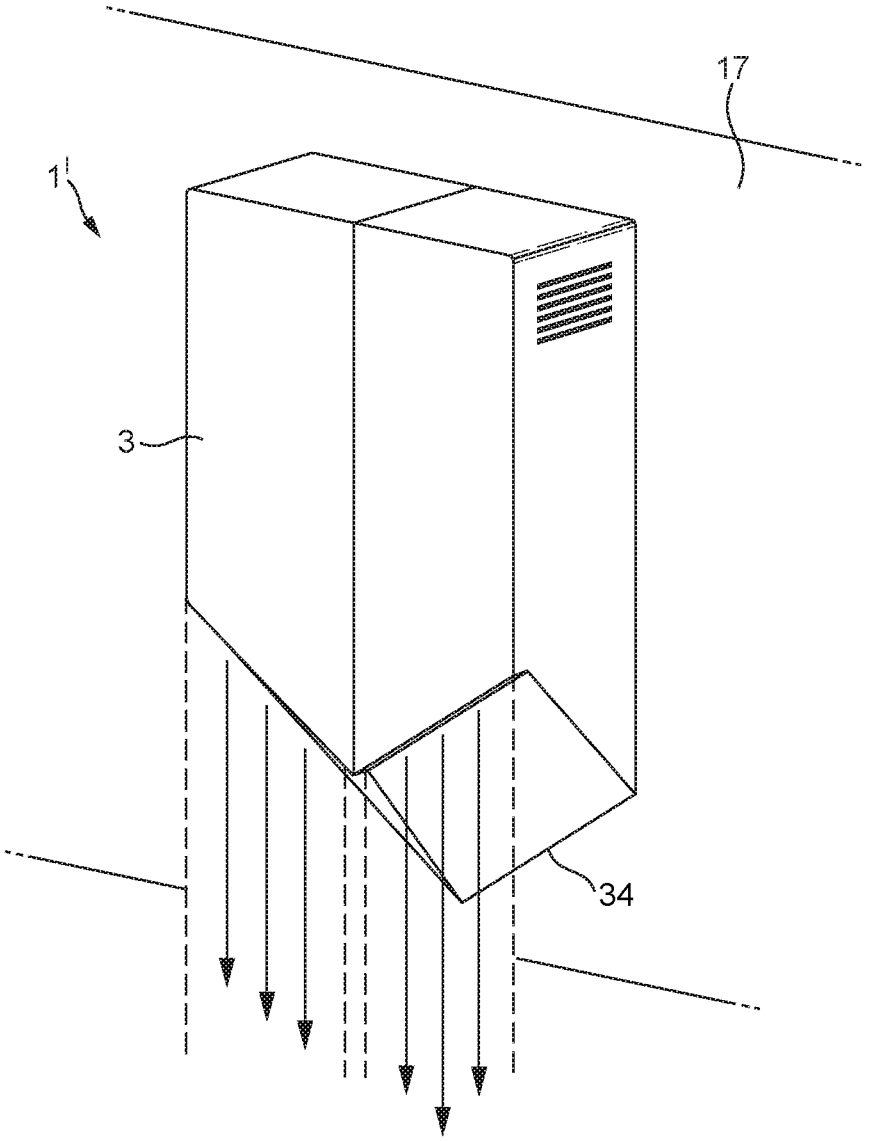
FIG. 17 is a front perspective view of an alternative hand dryer, illustrating the direction of the drying airflow.

In general, the degree of blow-back and spray-back experienced by the user will depend both upon the angle of declination, $\beta$, and the angle of divergence, $\phi$, of the first and second directions A, B. Relatively small angles of declination may be compensated for by relatively large angles of divergence and vice versa: if the air is directed straight down towards the floor, for example, the angle of divergence may be 0 degrees or close to 0 degrees (see hand dryer 1' in FIG. 17, similar in other respects to hand dryer 1).

Though not essential (see FIG. 17, for example), in the arrangements shown in FIG. 15 the angle of divergence of the air-sheets 11*a*, 13*a* corresponds specifically to the banking angle of the nozzle sections 11, 13 i.e. the drying air is ejected at a normal to the nozzle sections 11, 13. This means that the drying air impacts the hands "square-on"—looking along the roll axis of the hands—when the user banks the hands generally plane-parallel with the nozzle sections 11, 13.

Figure 18:
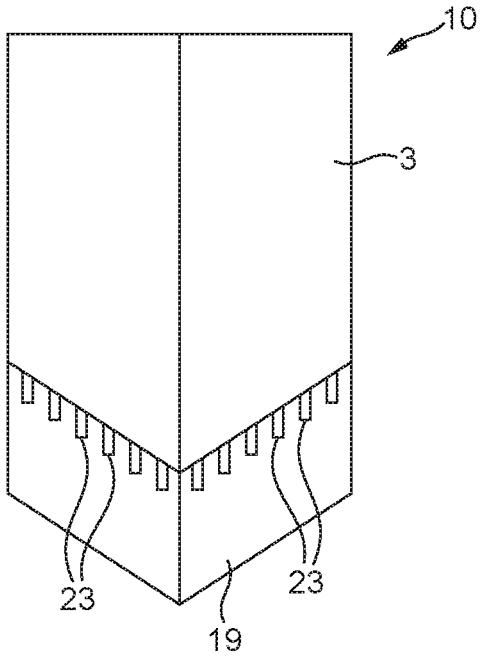
FIG. 18 is a front view of an alternative hand dryer, incorporating a banked row of nozzles.

FIG. 18 shows an alternative hand dryer 10, in which each nozzle section is in the form of a banked row of individual nozzles 23.

Figure 19:
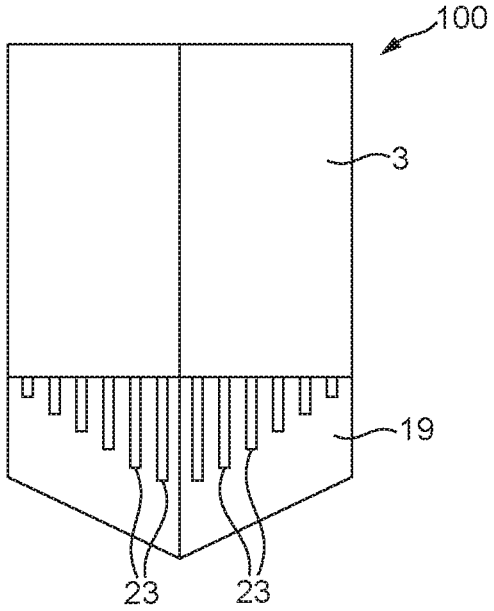
FIG. 19 is a front view of a hand dryer similar to the one shown in FIG. 18, but with the banked rows of nozzles provided on a flat underside of the dryer.

In the arrangement shown in FIG. 4, the underside of the dryer is V-shaped when viewed from the front of the dryer. This is not essential. FIG. 19 shows a different arrangement in which the nozzle sections—in this case banked rows of nozzles, 23—are provided on a flat underside of the hand dryer 100.

Figure 20:
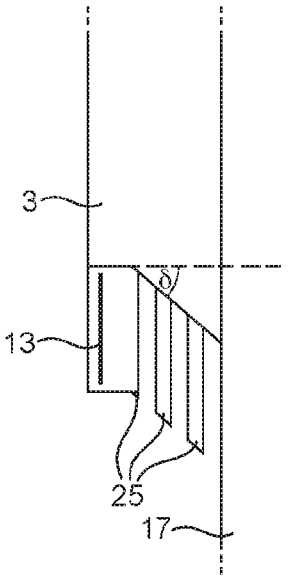
FIG. 20 is a side view of part of a hand dryer incorporating an alternative form of guide part behind the nozzle sections.

The guide part behind the nozzle sections need not be a continuous ramped surface. FIG. 20 shows an arrangement which uses a 'discontinuous' guide part, formed by a series of ribs 25, collectively pitched at an angle σ.

Figure 21:
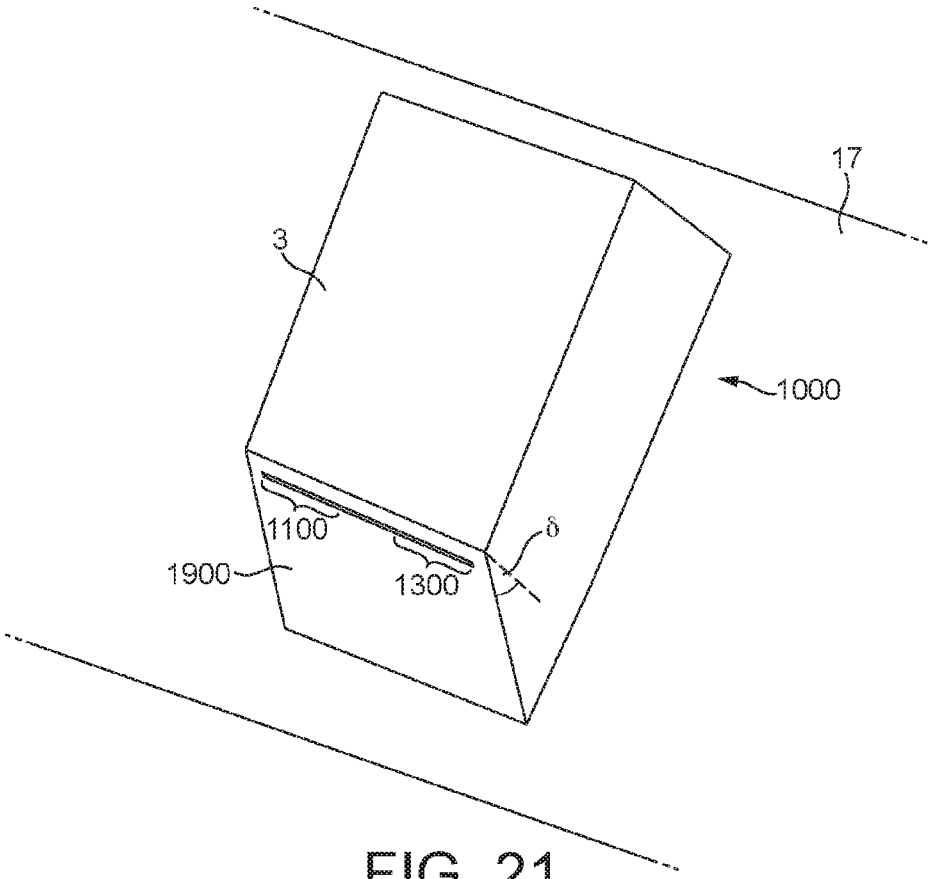
FIG. 21 is a perspective view of an alternative hand dryer—looking from underneath the dryer—comprising a single elongate air slot provided on a flat underside of the dryer.

Banked nozzle sections are not essential, though they make the drying action more comfortable. FIG. 21 shows an alternative dryer 1000 in which the nozzle sections form part of a single elongate slot provided at the front of the dryer, along a flat underside of the dryer. Thus, neither nozzle section is banked. Nevertheless, a guide part—here a continuous ramp surface 1900—is provided to guide the pitch of the user's hands underneath the nozzle sections 1100, 1300. The ramp surface 1900 here is not set back from the nozzle sections 1100, 1300 (cf. FIG. 13).

The invention claimed is:

1. A wall-mountable hand dryer for drying one side of a user's hands at a time, the dryer having two nozzle sections—one for each hand—which nozzle sections are positioned towards the front of the dryer so that they are spaced away from the wall in use, the nozzle sections each extending to span the width of a user's open hand and being arranged for directing drying air down onto the front or back of said hand as it is inserted lengthwise underneath the nozzle sections from the front of the dryer, wherein the dryer comprises a downwardly pitched continuous straight ramp surface positioned entirely behind each nozzle section on an underside of the hand dryer for guiding the pitch of the user's hands underneath the nozzle sections, and wherein the start of the ramp surface is set back from the nozzle sections a distance in excess of 5 mm and a terminal end of the ramp surface abuts the wall in use.

2. The hand dryer of claim 1, wherein the pitch of the ramp surface is 45 degrees.

3. The hand dryer of claim 2, in which the nozzle sections each comprise an elongate slot or row of nozzles.

4. The hand dryer of claim 1, wherein the width of the ramp surface behind each nozzle section is such as to span the entire length of the nozzle section.

5. The hand dryer of claim 4, in which the nozzle sections each comprise an elongate slot or row of nozzles.

6. The hand dryer of claim 1, in which the nozzle sections each comprise an elongate slot or row of nozzles.

* * * * *